US005380374A

United States Patent [19]

Tomlinson

[11] Patent Number: 5,380,374

[45] Date of Patent: Jan. 10, 1995

[54] CONVERSION COATINGS FOR METAL SURFACES

[75] Inventor: Charles E. Tomlinson, Martinsville, Ind.

[73] Assignee: Circle-Prosco, Inc., Bloomington, Ind.

[21] Appl. No.: 137,583

[22] Filed: Oct. 15, 1993

[51] Int. Cl.[6] ..... C23C 22/34

[52] U.S. Cl. ..... 148/247

[58] Field of Search ..... 148/247

[56] References Cited

U.S. PATENT DOCUMENTS 3,682,713 8/1972 Ries et al. .
3,964,936 6/1976 Das .
4,148,670 4/1979 Kelly .
4,273,592 6/1981 Kelly .
4,277,292 7/1981 Tupper .
4,313,769 2/1982 Frelin et al. .
4,326,894 4/1982 Konnert .
4,338,140 7/1982 Reghi .
4,470,853 1/1984 Das et al. .
4,617,068 10/1986 King .
4,786,336 11/1988 Schoener et al. .
4,816,086 3/1989 Oleske .
4,921,552 5/1990 Sander et al. .
4,992,116 2/1991 Hallman .
5,123,978 6/1992 Balin et al. .
5,139,586 8/1992 Das .

*Primary Examiner*—Sam Silverberg
*Attorney, Agent, or Firm*—Woodard, Emhardt, Naughton, Moriarty & McNett

[57] ABSTRACT

A conversion coating for aluminum, ferrous and magnesium alloyed materials includes zirconium, fluoride and calcium ions. The coating is preferably at a pH of between about 2.6 and about 3.1, and may optionally include phosphates, polyphosphates, tannin, boron, zinc and aluminum. A sequestering agent to complex dissolved iron, and a crystal deformation agent such as ATMP are also preferably included.

27 Claims, No Drawings

CONVERSION COATINGS FOR METAL SURFACES

FIELD OF THE INVENTION

The present invention relates generally to coatings for metal surfaces, and more particularly to conversion coatings for aluminum.

BACKGROUND TO THE INVENTION

A variety of chemical conversion coatings for aluminum or other metal surfaces are known to the art. All of these conversion coatings prevent metal surfaces from being converted to their metal oxide by corrosion by replacing or modifying the outer surface layer of the base metal. A corrosion resistant outer layer is thereby provided, while often simultaneously providing a surface for improved paint or other organic coating adhesion. Conversion coatings may be applied by a "no-rinse" process in which the metal surface to be coated is cleaned and the conversion coating is dipped, sprayed or rolled on, or they may be applied as one or more coats which are subsequently rinsed to remove undesirable residues from the coating process.

Many conversion coatings are chromate-based compositions. In general, chromate-based conversion coatings are acidic, aqueous compositions comprising chromic acid and chemical supplements. In order to improve deposition of the coating to the metal surface, alkali metal salts and/or mineral acids may be added to adjust solution pit.

More recently, chromate-free conversion coatings have also been developed. These coatings are especially useful for applications, such as coating aluminum food or beverage cans, in which it is particularly desirable to avoid potentially toxic chromates. Chromate-free conversion coatings typically employ a Group IVA metal such as titanium, zirconium or halfnium, a source of fluoride ion and a mineral acid for pH adjustment. Conversion coatings of this sort are typically clear in color, and are commonly used to prevent the blackening that normally occurs when aluminum is boiled in water during pasteurization.

For example, U.S. Pat. No. 3,964,936 to Das discloses the use of zirconium, fluoride, nitric acid and boron to produce a conversion coating for aluminum. U.S. Pat. No. 4,148,670 to Kelly discloses a conversion coating comprising zirconium, fluoride and phosphate. U.S. Pat. No. 4,273,592 to Kelly discloses a coating comprising zirconium, fluoride and a $C_{1-7}$ polyhydroxy compound, wherein the composition is essentially free of phosphate and boron. U.S. Pat. No. 4,277,292 to Tupper discloses a coating comprising zirconium, fluoride and a soluble vegetable tannin.

U.S. Pat. No. 4,338,140 to Reghi discloses a conversion coating comprising zirconium, fluoride, vegetable tannin and phosphate, and optionally including a sequestering agent to complex hard water salts such as calcium, magnesium and iron. U.S. Pat. No. 4,470,853 to Das et al. discloses a coating comprising zirconium, fluoride, vegetable tannin, phosphate and zinc. U.S. Pat. No. 4,786,336 to Schoener et al. discloses a coating comprising zirconium, fluoride and a dissolved silicate, while U.S. Pat. No. 4,992,116 to Hallman discloses a conversion coating comprising a fluoroacid of zirconium and a polyalkenyl phenol.

It can be seen from the above that the compositions of the prior art have not combined Group IIA metals such as calcium with Group IVA metals such as zirconium to provide corrosion resistant coatings. In fact, prior art compositions have expressly avoided Group IIA metals since at low concentrations such metals are known to cause scaling from alkali metal precipitates. As was noted above, U.S. Pat. No. 4,338,140 to Reghi uses a sequestering agent such as EDTA to complex hard water components such as calcium and magnesium.

It should further be noted that the conversion coatings of the prior art have not proven particularly effective for certain applications. For example, formed aluminum parts used in automotive heat exchange devices (such as air conditioner evaporators) which are exposed to highly corrosive environments have not been effectively treated using known cromate-free coatings.

A need therefore exists for improved conversion coatings for providing a high level of corrosion resistance to aluminum and other metals, such as magnesium and ferrous alloys, used in aggressive environments. The present invention addresses that need.

SUMMARY OF THE INVENTION

The present invention provides improved conversion coatings based on Group IVA metals such as zirconium by combining the Group IVA metal with a group IIA metal such as calcium. In one aspect of the invention, an aqueous conversion coating is provided comprising between about 10 ppm and about 5,000 ppm zirconium, between about 50 ppm and about 1300 ppm calcium, and between about 10 ppm and about 6,000 ppm fluoride; the composition having a pH of between about 2.0 and about 5.0. The coating may optionally include polyphosphates, tannin, phosphates, boron and zinc; a sequestering agent to complex dissolved iron, and a crystal deformation agent such as ATMP may also be included.

One object of the present invention is to provide improved conversion coatings for aluminum automotive parts such as wheels, body panels and heat exchange devices.

Further objects and advantages of the present invention will be apparent from the following description.

DESCRIPTION OF THE PREFERRED EMBODIMENT

For the purpose of promoting an understanding of the principles of the invention, reference will now be made to preferred embodiments and specific language will be used to describe the same. It will nevertheless be understood that no limitation of the scope of the invention is thereby intended, such alterations and further modifications in the illustrated embodiments, and such further applications of the principles of the invention as illustrated herein being contemplated as would normally occur to one skilled in the art to which the invention pertains.

As indicated above, the present invention relates generally to chromate-free compositions which provide a highly corrosion resistant coating on the surface of metal substrates. In particular, coatings based on Group IVA metals such as zirconium are disclosed, with the traditional performance of Group IVA coatings being improved by adding calcium to the mix. The inventive compositions produce a hydrophilic, corrosion resistant coating on iron, aluminum and magnesium while providing a surface that gives improved adhesion of paint and other organic coatings.

In one aspect of the present invention a corrosion resistant conversion coating is provided comprising a Group IVA metal such as titanium, zirconium or halfnium, a Group IIA metal such as calcium or magnesium, and a source of fluoride ions. The composition is preferably provided at a pH of between about 2.0 and 4.5, most preferably between about 2.6 and 3.1.

As indicated, the Group IVA metal may be titanium, zirconium or halfnium. (Group IVA refers to the IUPAC nomenclature; the corresponding CAS designation for these metals is Group IVB. Alternatively, these metals may be designated merely as Group 4.) In most applications zirconium is used, due primarily to its commercial availability and lower cost. Other Group IVA metals may be used as desired for a particular commercial application.

The zirconium or other Group IVA metal is provided in ionic form which is easily dissolved in the aqueous coating composition. For example, $K_2ZrF_6$, $H_2ZrF_6$ or $Zr(O)(NO_3)_2$ may effectively be used. Note that the source of Group IVA metal ion may also be a source of fluoride ion, commonly an alkali metal fluorozirconate salt. Potassium hexafluorozirconate is most preferred.

The Group IIA metal may be calcium, magnesium, beryllium, strontium or barium, with calcium being preferred in one embodiment. The Group IIA metal may be provided as any of the many inorganic hydroxides or salts available, including the nitrates, sulfates, fluorides, etc. For example, $Ca(OH)_2$, $Ca(NO_3)_2$, etc., may be used, with calcium nitrate being most preferred in one embodiment.

A source of fluoride ion is also included to maintain the solubility of metals in solution. The fluoride may be added as an acid (e.g., HF), as any of the many fluoride salts (e.g., KF, NaF, etc.), as the complex metal fluoride of the Group IVA metal, or in any other form which will donate fluoride to the working solution. Most preferably the fluoride is added as $K_2ZrF_6$ and KF.

The fluoride is preferably present in a molar ratio of at least 4 moles fluoride to each mole of metal. The concentration of fluoride in the working solution is selected such that the metals remain soluble and little or no etching of the substrate occurs. The particular fluoride level is also selected according to the pH and metal concentration of the coating solution, knowing that the fluoride will move from the higher order metal fluorides to the lower order and preferentially to the metallic (oxide) surface. A small amount of etching of an oxide surface is acceptable, but much of the metal oxide present on the surface prior to coating should be retained to give additional protection in a corrosive environment and to extend the life of the coating solution.

The pH of the coating is normally between about 1.5 and 5.0, preferably between about 2.0 and 4.0, most preferably between about 2.6 and 3.1. The pH may be adjusted by adding a group IVA metal acid, an acid fluoride, or other mineral acids such as $HNO_3$, $H_2SO_4$, etc. Most preferably, $HNO_3$ is used. Generally, higher levels of metal concentration necessitate lower pH levels and, with increasing levels of metal and acid, a heavier coating is obtained under these conditions.

The temperature of the working solution preferably ranges from about 70° F. to about 160° F. Appropriate working solution temperatures for particular applications may be selected by persons skilled in the art without undue experimentation.

Acceptable coatings can be formed from solutions containing from $1.5\times10^{-4}$M to $5.5\times10^{-2}$M Group IVA metals, with $2.5\times10^{-4}$M to $3.0\times10^{-2}$M Group IIA metals. The best ratio of Group IVA to Group IIA metal depends on the method of coating solution contact (spray, dip, flood, etc.), working bath temperature, pH, and fluoride concentration. For example, for a five minute immersion at 80° to 140° F., 150 to 600 ppm Zr, 40 to 300 ppm Ca and 200 to 740 ppm $F^-$, at a pH from 2.6 to 3.1, gives superior corrosion protection.

Working solutions can be made up to the solubility limits of the components in combination to provide acceptable coatings. Lower levels are preferred, however, as dissolved substrate metal ions entering the coating solution during processing may cause precipitation of bath components. As will be discussed further, when bath component precipitates are formed, the addition of a chelant such as Versenex 80 to a bath for treatment of ferrous substrate will yield a soluble ion complex with dissolved iron, extending the life and efficiency of the working solution.

In a second aspect of the invention the quality of the coating is improved by adding, e.g., phosphates, polyphosphates, tannin, aluminum, boron, zinc, a sequestering agent to complex dissolved iron, and a crystal deformation agent such as ATMP. In the most preferred embodiment, all of these components are included.

The addition of a tripolyphosphate (as $Na_5P_3O_{10}$ or other polyphosphate salt) will assist in maintaining high levels of calcium in the treatment bath, as soluble calcium complexes will form with tripolyphosphate and provide a "reservoir" of calcium to the solutions.

The addition of phosphate to the working bath also adds both to corrosion protection and to paint adhesion to the coating obtained. It is commonly believed that the incorporation of phosphates into certain conversion coatings enhances protection from "pitting" corrosion; as when a pit is initiated in a corrosive environment, the phosphate present will first dissolve into the pit area and, there, form insoluble salts with base (substrate) metal ions or other coating components, effectively sealing the pit.

Organic additives such as tannic acid or vegetable tannins in plating and chemical conversion coating systems are beneficial in promoting uniformity of coating, organic coating adhesion, and corrosion resistance. Tannic acid and vegetable tannins may be incorporated into the treatments disclosed here and do give the benefits listed above. Tannic acid shows beneficial effects in a very broad range, from 10 ppm to its solubility limit. At higher levels, the coating becomes very golden brown as much of the tannate has become incorporated into the coating. Optimum levels of tannic acid and vegetable tannins are from 50 to 500 ppm.

The addition of boron in the form of boric acid or a borate salt to the working solution improves certain properties of the coating, such as corrosive resistance. Borate anions in the presence of calcium will form a continuous polymeric oxide structure with the basic $CAB_2O_4$ composition. This, along with the zirconium and zirconate matrix, is believed to be a source of improved corrosion protection. The preferred range for boron is 50 to 100 ppm, typically present at 10 to 200 ppm.

The addition of zinc to the working solution produces coatings with improved corrosion resistance. It is believed the zinc accelerates coating deposition and, when incorporated into the coating (if reduced) may provide galvanic protection to the metal substrate. The typical range for zinc is 5 to 100 ppm, preferably 10 to 30 ppm.

Aluminum added to the working solution increases the rate of deposition of insoluble salts in the coating. Aluminum may be added in any form of soluble aluminum salt, preferably as a hydrated aluminum nitrate. Typically, aluminum may be present at 50 to 1000 ppm, preferably at 100 to 200 ppm.

It should be noted that the presence of iron in working solutions for aluminum and other metals may decrease the corrosion protection obtained. A chelant such as EDTA, triethanolamine, or Versenex 80 will preferentially complex the iron in solution, at the preferred pH values stated, and inhibit its incorporation into the conversion coatings.

Additionally, calcium salts which may form in the higher end of the temperature range mentioned may be more soluble at the lower temperatures and, therefore, the working solution should be used at the lower end of the temperature range when the calcium content of the working solution is at the high end of the levels stated.

Crystal deformation additives such as nitrilotris (methylene)triphosphoric acid function to reduce the average crystal size of the deposited coating, providing a more uniform surface texture. This promotes even deposition of coating and enhances paint adhesion to the surface. An additive such as ATMP may be used in a broad concentration range (10 to 2000 ppm) and is preferably used from 50 to 200 ppm.

Working solutions composed of mixture(s) of the above components may be applied by spray, dip, or roll coat application. After the coating has formed, the surface should be rinsed with clean water. The rinse(s) may be deionized or tap water and should remove any soluble salts which might be present on the surface.

The surface obtained is hydrophilic and may be coated with an organic or silicate coating. Adhesion of organic coatings is improved when compared to untreated metal. Treatment with a silicate, preferably a 1 to 15 weight % sodium silicate solution, extends the life of the metallic substrate in a corrosive environment.

It is to be appreciated that siccative coatings which form an organic barrier may also be necessary for decorative purposes of the final product. Silicates (such as Sodium Silicate Grade #40 at 0.5% to 20% in water) deposit and react with the formed coating to provide additional corrosion protection while maintaining a hydrophilic surface. The silicate drys and forms a network of siloxyl linkages. The corrosion protection is enhanced by the silicate as with the siccative type coatings. The siccative type coatings usually leave a surface which is hydrophobic.

Reference will now be made to specific examples using the processes described above. It is to be understood that the examples are provided to more completely describe preferred embodiments, and that no limitation to the scope of the invention is intended thereby.

EXAMPLE 1

A calcium-free conversion coating solution was prepared in distilled water as follows. Potassium hexafluorozirconate (1.0 grams $K_2ZrF_6$ per liter, providing approximately 313 ppm Zr and approximately 402 ppm F) was provided in aqueous solution at a pH of 2.6 with nitric acid. A calcium-free conversion coating was formed.

EXAMPLE 2

A conversion coating solution was prepared in distilled water as follows. Potassium hexafluorozirconate (1.0 grams $K_2ZrF_6$ per liter, providing approximately 313 ppm Zr and approximately 402 ppm F) was added to a solution of calcium hydroxide (148 mg $Ca(OH)_2$ providing approximately 80 ppm Ca) and nitric acid. The solution pH was adjusted to 2.6 with 0.273 ml 42° Baume $HNO_3$. A conversion coating according to the present invention was formed.

EXAMPLE 3

A preferred embodiment of a conversion coating solution was prepared in distilled water as follows. Potassium hexafluorozirconate (1.0 grams per liter providing approximately 313 ppm Zr and approximately 402 ppm F) was added to a solution containing 148 mg $Ca(OH)_2$, 500 mg $Na_2B_4O_7.10H_2O$, 1.0 mL 42° Baume $HNO_3$, 500 mg sodium tripolyphosphate, 200 mg $KF{\cdot}2H_2O$, and 100 mg of tannic acid per liter aqueous solution.

EXAMPLE 4

Aluminum (3003) panels were treated with the basic conversion coatings of Examples 1–3 (two panels for each example coating) for 5 minutes at 140° F. The panels were oven dried at 300° F. for 5 minutes.

One panel was taken from each of the above sets and treated (5 minute dip at 120° F.) with a 10% by weight Grade 40 sodium silicate solution in deionized water. After the sodium silicate treatment, the panels were dried for 5 minutes at 300° F.

All panels were exposed to a solution comprising 5% NaCl and $8.0\times10^{-4}$ M acetic acid (pH=3.1) at 90°–92° F. This test is commonly referred to as SWAAT.

Results are given in the table below, giving the percent area showing pitting (in a 10×20 grid) of the treated panels for up to four days exposure.

% AREA OF PANEL SHOWING PITTING AFTER TREATMENTS WITH COMPOSITIONS IN EXAMPLES 1–3. EACH TREATMENT IS SHOWN WITH AND WITHOUT A SECONDARY SILICATE TREATMENT.

| | Days in SWAAT at 90–92° F. | | | | | | | |
|---|---|---|---|---|---|---|---|---|
| Composition | 0.033 | 0.065 | 0.125 | 0.25 | 1 | 2 | 3 | 4 |
| Example 1 | 0 | 0 | 15 | 20 | 50 | 60 | 90 | 100 |
| Example 2 | 0 | 0 | 0 | 5 | 40 | 50 | 80 | 100 |
| Example 3 | 0 | 0 | 0 | 0 | 20 | 40 | 60 | 90 |
| Example 1 with a secondary treatment with a sodium silicate solution | 0 | 0 | 0 | 8 | 10 | 15 | 30 | 50 |
| Example 2 with a secondary treatment with a sodium silicate solution | 0 | 0 | 0 | 0 | 2 | 3 | 5 | 20 |
| Example 3 with a secondary treatment | 0 | 0 | 0 | 0 | 0 | 0 | 0 | 0 |

-continued

% AREA OF PANEL SHOWING PITTING AFTER TREATMENTS WITH COMPOSITIONS IN EXAMPLES 1-3. EACH TREATMENT IS SHOWN WITH AND WITHOUT A SECONDARY SILICATE TREATMENT.

| | Days in SWAAT at 90-92° F. | | | | | | | |
|---|---|---|---|---|---|---|---|---|
| Composition | 0.033 | 0.065 | 0.125 | 0.25 | 1 | 2 | 3 | 4 |
| with a sodium silicate solution | | | | | | | | |

EXAMPLE 5

Evaporators used in air conditioning units were coated with the preferred embodiment of the coating. The evaporators were treated at 140° F. solution temperature by immersion for 5 minutes followed by a 10% grade 40 silicate treatment at 120° F. The evaporators were thoroughly rinsed with tap water for 30 seconds and dried at 300° F. for 10 minutes. The evaporators were tested and passed requirements for SWAAT (500 hours without loss of refrigerant pressure) and neutral salt (1,000 hours without perforation) testing. The units also passed requirements for "wet ΔP" tests. (The wet ΔP test measures the drop in air pressure from one side of the evaporator to the other in 50% and 90% humidity environments.) No difference was seen between the two levels, indicating excellent watershedding capability of the coating and excellent hydrophilicity.

While the invention has been illustrated and described in detail in the drawing and foregoing description, the same is to be considered as illustrative and not restrictive in character, it being understood that only the preferred embodiment has been shown and described and that all changes and modifications that come within the spirit of the invention are desired to be protected.

We claim:

1. An aqueous composition for coating aluminum, ferrous or magnesium alloys, comprising:

(a) between about 10 ppm and about 5,000 ppm, based on the aqueous composition, of dissolved Group 4 metal ions selected from the group consisting of titanium, zirconium and halfnium;

(b) between about 80 ppm and about 1300 ppm, based on the aqueous composition, of dissolved Group 2 metal ions selected from the group consisting of magnesium and calcium;

(c) between about 10 ppm and about 6,000 ppm, based on the aqueous composition, of dissolved fluoride ions; and (d) water;

said composition having a pH of between about 2.0 and about 5.0.

2. A aqueous composition according to claim 1 wherein the Group 4 metal is zirconium.

3. A aqueous composition according to claim 1 wherein the Group 2 metal is calcium.

4. A coating composition according to claim 3 wherein said calcium ions are present in the amount of between about 100 ppm and about 500 ppm of the aqueous composition.

5. A coating composition according to claim 3 wherein said calcium ions are present in the amount of between about 150 ppm and about 250 ppm of the aqueous composition.

6. A coating composition according to claim 3 wherein said zirconium ions are present in the amount of between about 200 ppm and about 1,000 ppm of the aqueous composition.

7. A coating composition according to claim 3 wherein said zirconium ions are present in the amount of between about 200 ppm and about 400 ppm of the aqueous composition.

8. A coating composition according to claim 3, and further including a source of tripolyphosphate ions.

9. A coating composition according to claim 8 wherein said source of tripolyphosphate ions is sodium tripolyphosphate.

10. A coating composition according to claim 9 wherein said tripolyphosphate ions are present in the amount of between about 60 ppm to about 4,400 ppm.

11. A coating composition according to claim 10 wherein said tripolyphosphate ions are present in the amount of between about 150 ppm to about 200 ppm.

12. A coating composition according to claim 3, and further including at lease about 10 ppm of tannic acid or vegetable tannin.

13. A coating composition according to claim 12 wherein said tannic acid or vegetable tannin is present in the amount of about 50 ppm to about 200 ppm.

14. A coating composition according to claim 3, and further including a sequestering agent in an amount effective to complex essentially all dissolved iron present in the composition.

15. A coating composition according to claim 3, and further including a source of boron.

16. A coating composition according to claim 15 wherein said boron is present in the amount of between about 10 ppm to about 200 ppm.

17. A coating composition according to claim 16 wherein said boron is present in the amount of between about 50 ppm to about 100 ppm.

18. A coating composition according to claim 3 and further including a phosphate salt in an amount effective to provide a phosphate concentration of between about 10 ppm to about 600 ppm.

19. A coating composition according to claim 18 wherein said phosphate salt is present in an amount effective to provide a phosphate concentration of between about 150 ppm to about 300 ppm.

20. A coating composition according to claim 3 and further including zinc ion at a concentration of between about 10 ppm to about 100 ppm.

21. A coating composition according to claim 20 wherein said zinc ion is present at a concentration of between about 20 ppm to about 30 ppm.

22. A coating composition according to claim 3 wherein said composition has a pH of between about 2.6 and 3.1.

23. A coating composition according to claim 3 and further including a crystal deformation agent.

24. A coating composition according to claim 23 wherein said crystal deformation agent is nitrilotris (methylene) triphosphonic acid (ATMP).

25. A coating composition according to claim 3 and further including dissolved aluminum ion at a concentration of between about 10 and about 3,000 ppm.

26. A coating composition according to claim 25 wherein said aluminum is present at a concentration of between about 100 and 600 ppm.

27. A method of treating metal, comprising applying to the metal an aqueous coating composition comprising:

(a) between about 10 ppm and about 5,000 ppm, based on the aqueous composition, of dissolved metal ions selected from the group consisting of titanium, zirconium and halfnium;

(b) between about 80 ppm and about 1300 ppm, based on the aqueous composition, of dissolved metal ions selected from the group consisting of magnesium and calcium;

(c) between about 10 ppm and about 6,000 ppm, based on the aqueous composition, of dissolved fluoride ions; and (d) water; said composition having a pH of between about 2.0 and about 5.0.

* * * * *

UNITED STATES PATENT AND TRADEMARK OFFICE

CERTIFICATE OF CORRECTION

PATENT NO. : 5,380,374

DATED : January 10, 1995

INVENTOR(S) : Charles E. Tomlinson

It is certified that error appears in the above-indentified patent and that said Letters Patent is hereby corrected as shown below:

Column 1, line 31: "pit" should read "pH".

Signed and Sealed this

Twenty-fifth Day of April, 1995

*Attest:*

Bruce Lehman

BRUCE LEHMAN

*Attesting Officer*

*Commissioner of Patents and Trademarks*